US008162586B2

(12) United States Patent
Webb et al.

(10) Patent No.: US 8,162,586 B2
(45) Date of Patent: Apr. 24, 2012

(54) PARKING STAND

(75) Inventors: Daniel Webb, Forest Reefs (AU); Tim Smith, Forest Reefs (AU); Collin O'shaughnessy, Borenore (AU)

(73) Assignee: Challenge Implements Holdings Pty Limited, Orange, New South Wales (AU)

( * ) Notice: Subject to any disclaimer, the term of this patent is extended or adjusted under 35 U.S.C. 154(b) by 97 days.

(21) Appl. No.: 12/519,045

(22) PCT Filed: Dec. 7, 2007

(86) PCT No.: PCT/AU2007/001888

§ 371 (c)(1),
(2), (4) Date: Nov. 19, 2009

(87) PCT Pub. No.: WO2008/070901

PCT Pub. Date: Jun. 19, 2008

(65) Prior Publication Data

US 2010/0095563 A1 Apr. 22, 2010

(30) Foreign Application Priority Data

Dec. 13, 2006 (AU) ..... 2006906964

(51) Int. Cl.
*E02F 3/40* (2006.01)
*E02F 3/36* (2006.01)

(52) U.S. Cl. ..... 414/686; 37/444

(58) Field of Classification Search ..... 37/403–409, 37/444; 172/272–275; 414/685, 686, 722, 414/490, 495
See application file for complete search history.

(56) References Cited

U.S. PATENT DOCUMENTS 4,275,984 A * 6/1981 Lenertz ..... 414/686
4,347,031 A * 8/1982 Friesen et al. ..... 414/686
4,780,046 A 10/1988 Friesen et al.
5,531,561 A * 7/1996 Rae et al. ..... 414/686
6,231,295 B1 5/2001 Girstenbrei et al.
6,247,888 B1 6/2001 BiGuiet

* cited by examiner

*Primary Examiner* — Robert Pezzuto
(74) *Attorney, Agent, or Firm* — Whitham, Curtis, Christofferson & Cook, P.C.

(57) ABSTRACT

A loader parking stand includes a support leg pivoted to a loader arm which is movable between an extended and a retracted position. A retaining latch can releasably secure or lock the stand in the extended position and the retaining latch can be unlocked or released to unlock the support leg by motion of or engagement with a movable portion of the loader.

21 Claims, 13 Drawing Sheets

PARKING STAND

FIELD OF THE INVENTION

The present invention relates generally to a stand device for boom-type working implements such as front loaders and the like, and more particularly, the present invention relates to a parking stand.

BACKGROUND OF THE INVENTION

Front loaders, also called front end loaders, bucket loaders, scoop loaders etc, are well known in the art. Although the design of front loaders can significantly differ, certain components are common to all front loaders. Thus one of the main components of a front loader is one or more movable arms adapted to lift and move material.

To this end, a front loader is typically provided with a tilting bucket connected to the one or more movable arms.

Since front loaders are often required for short operations and at infrequent intervals, such implements are normally detachably attached to a vehicle (e.g., a tractor) so that the front loader can be removed from the vehicle and parked. When detached from the vehicle, the front loader is typically placed on the ground in an upright position. To keep the front loader in its upright position, the front loader can be provided with a parking stand.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a loader including: at least one loader arm having at least one movable portion, such as implement mounting means, at one end thereof; a parking stand including a support leg pivotally attached to said arm for pivoting about an axis, said parking stand being movable between a retracted position and an extended position; and lock means for locking said stand in said extended position, wherein said movable portion is able to release said lock means to thereby unlock same.

Preferably said movable portion moves said parking stand from said extended position to said retracted position.

The loader can include tilting means for tilting said implement mounting means relative to said arm, and said tilting means can be operably connected to said lock means to thereby unlock same.

The loader can include lift means for moving said arm between a raised position and a lowered position.

The loader can include retaining means provided on said loader arm for releasably securing said parking stand in the retracted position.

The implement mounting means can include actuating means for automatically releasing said lock means, said actuating means being operably connected to said tilting means.

The actuating means can include an actuating member, said actuating member being operably connected to the tilting means, and said lock means can include a catch provided on said parking stand, the arrangement being such that during tilting movement of the implement the actuating member aligns with and impinges against the catch to thereby automatically release said lock means.

Upon said release of said lock means, further tilting movement of said implement mounting means can cause the parking stand to pivot to its retracted position.

Preferably further tilting movement of said implement mounting means will cause an automatic locking of said retaining means to thereby secure said parking stand in the retracted position.

Said retaining means can include spring means for normally biasing said retaining means toward a latching position.

The present invention also provides a parking stand assembly for a loader, the assembly including a parking stand having a support leg pivotally attached to a loader arm, said parking stand being movable between a retracted position and an extended position; retaining means for releasably securing said parking stand in the extended position, wherein said retaining means is released by a portion of said loader being made to engage said retaining means.

Upon release of said retaining means, said movable portion moves said parking stand from said extended position to said retracted position.

The present invention also provides a parking stand for a loader, said parking stand including a support leg, said parking stand being movable between an extended position and a retracted position, wherein the support leg includes a contact surface adapted to contact a movable portion of said loader, the arrangement being such that said movable portion is adapted to move said parking stand from said extended position to said retracted position.

Said contact surface can include a planar surface.

Said contact surface can include a curved surface.

The present invention further provides a method of folding a parking stand for a loader, said parking stand including retaining means for releasably securing said parking stand in an extended position, said method including the step of providing actuating means on said loader, said actuating means being adapted to release said retaining means.

Upon said release of said retaining means, further operation of said actuating means will cause the parking stand to move to its retracted position.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

Figure 1:
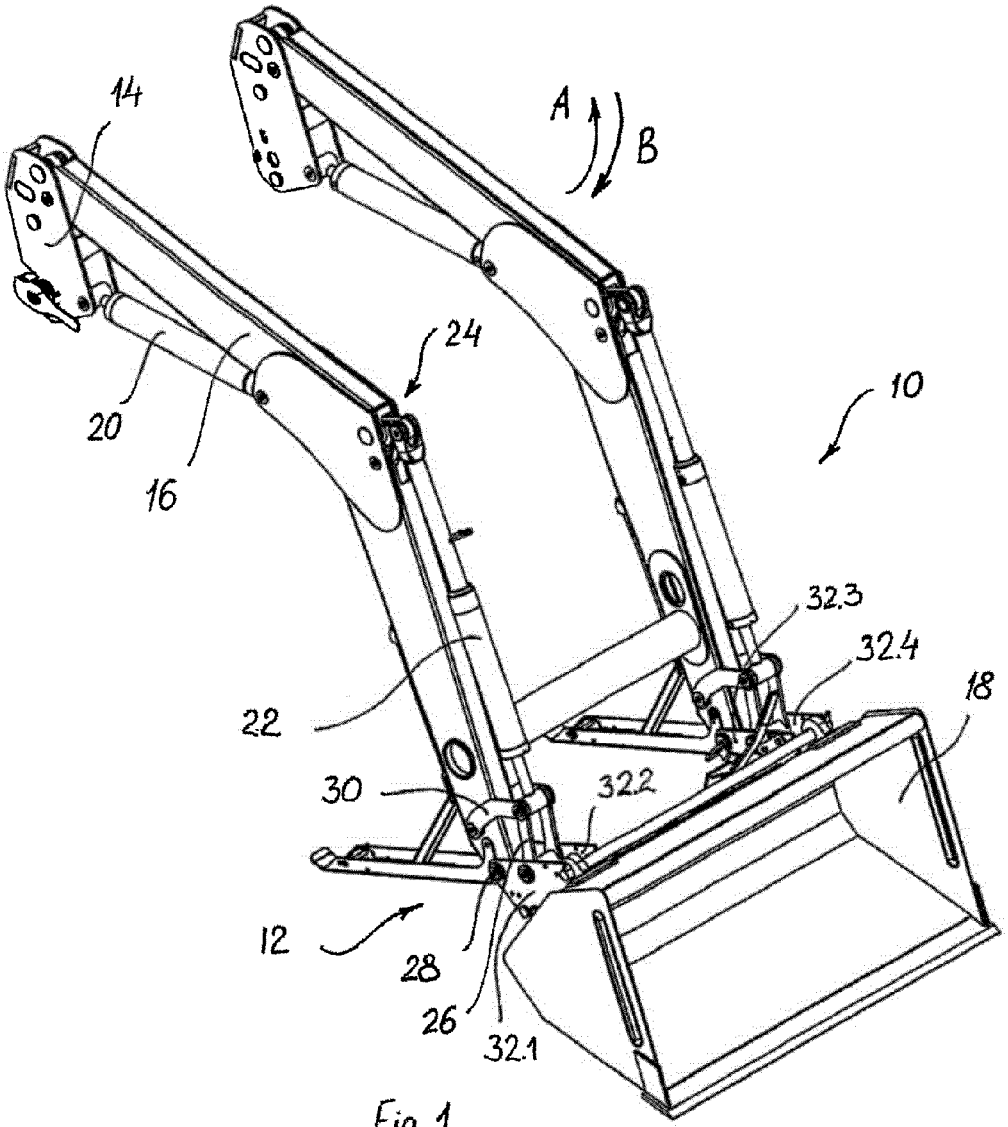
FIG. 1 is a perspective view of a front loader provided with a parking stand according to an embodiment of the present invention.

Illustrated in FIG. 1 is a front loader 10 provided with a parking stand assembly 12. The front loader 10 includes a front end loader top post 14. Pivotably extending from an upper end of the front end loader top post 14 is a boom 16.

A bucket 18 is pivotably connected to a distal end of the boom 16. A lift cylinder 20 extends between the front end loader top post 14 and the boom 16. The lift cylinder 20 is used to lift and lower the boom 16 in a vertical plane, as indicated by arrows A and B in FIG. 1.

In the front loader illustrated in FIG. 1, there is an implement cylinder 22 which extends between the bucket 18 and an internally housed triangular plate 24 pivotably attached to the boom 16. An implement end of the implement cylinder 22 is pivotably connected to the bucket 18 via a link 26. This is described in more detail in co-pending application AU2006903984, and is only of no direct relevance to the present invention. If desired the triangular plate 24 or similar construction can be externally located, or alternative construction utilised. The triangular plate 24 is a component in a mechanical self levelling mechanism. Such a self levelling system is a preferment and need not be present. Alternative boom constructions have the implement cylinder 22 connected to a plate welded to the boom.

The bucket 18 is pivotably connected to the boom 16 by pivot means 28 providing pivotal movement of the bucket 18 in a suitable angular range. The implement end of the implement cylinder 22 is also pivotably connected to the distal end of the boom 16 via a link 30.

Figure 3:
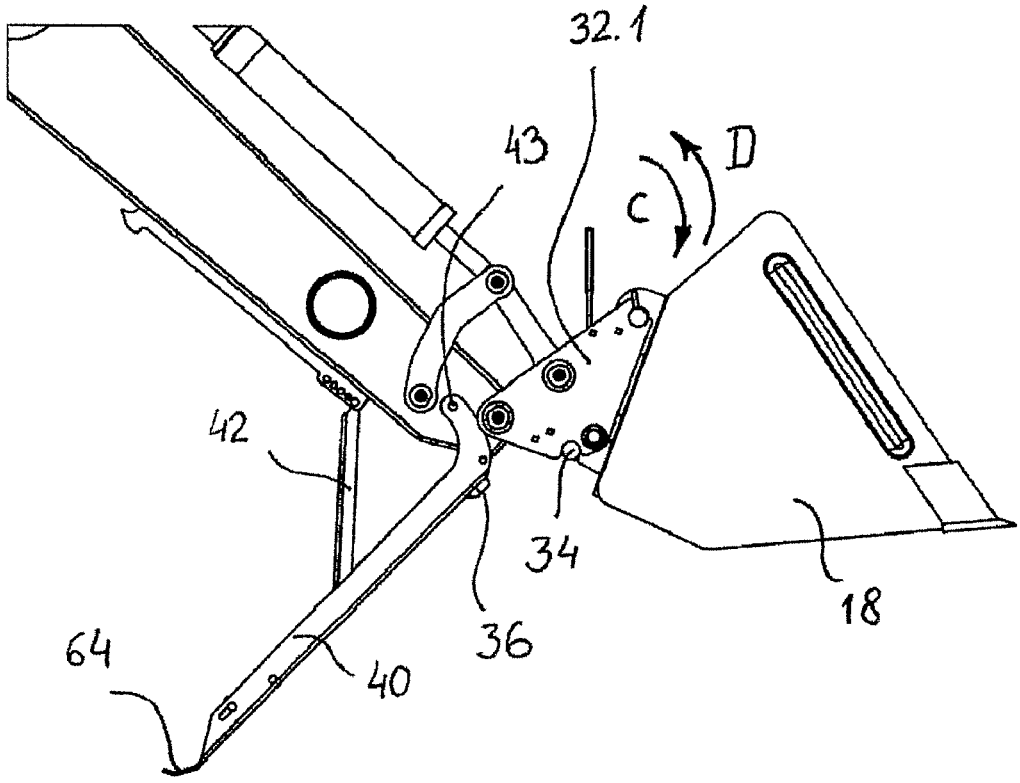
FIG. 3 is an enlarged side view of the forward portion of the front loader of FIG. 1, showing the front loader in a raised position and a bucket mounted on the implement mount.
Figure 9:
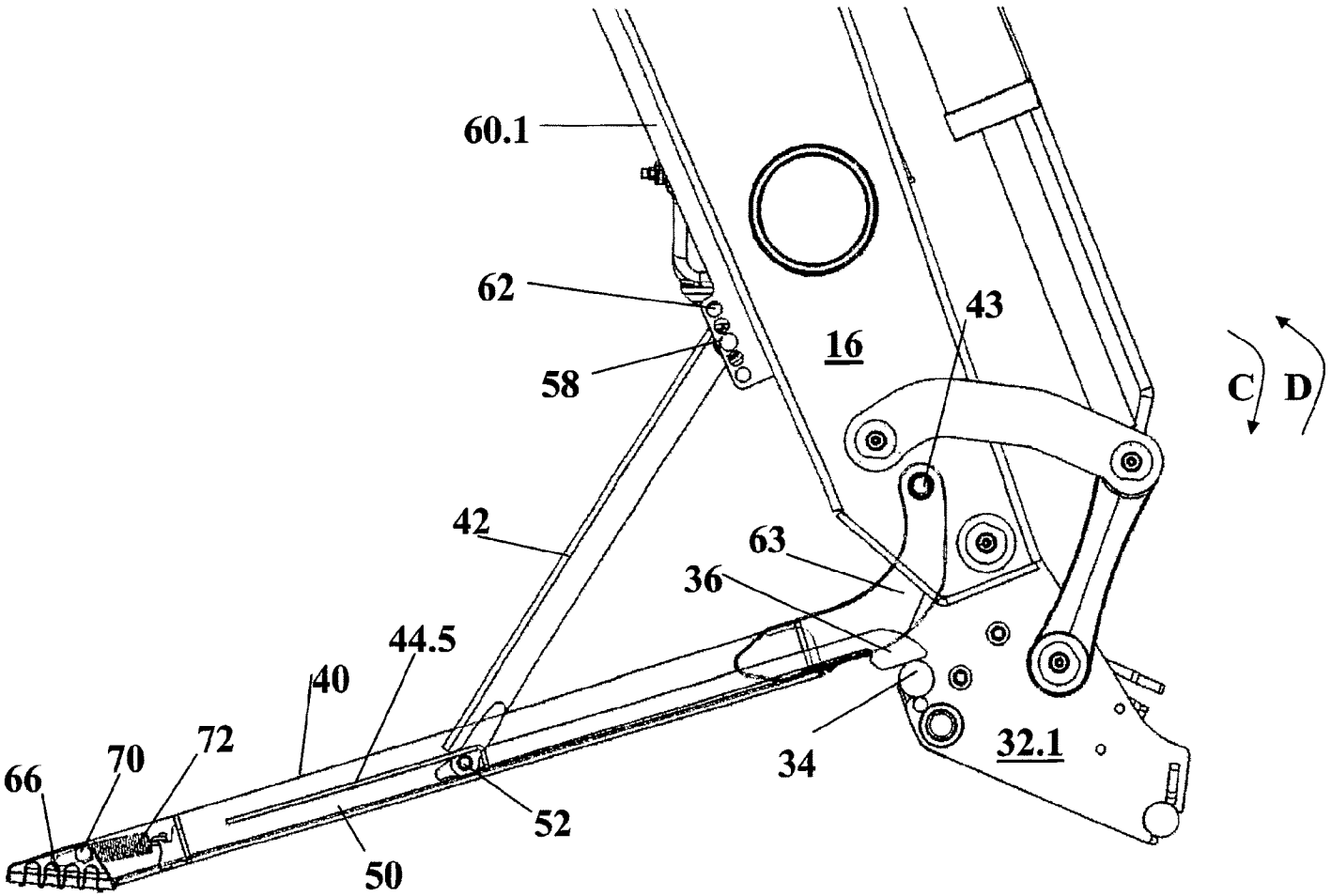
FIGS. 9 to 12 show successive stages in folding the parking stand of FIG. 8 from an extended condition to a retracted condition.

The implement cylinder 22 is used to turn the bucket 18 upwardly and downwardly in a vertical plane, as indicated by arrows C and D in FIGS. 3 and 9.

Figure 4:
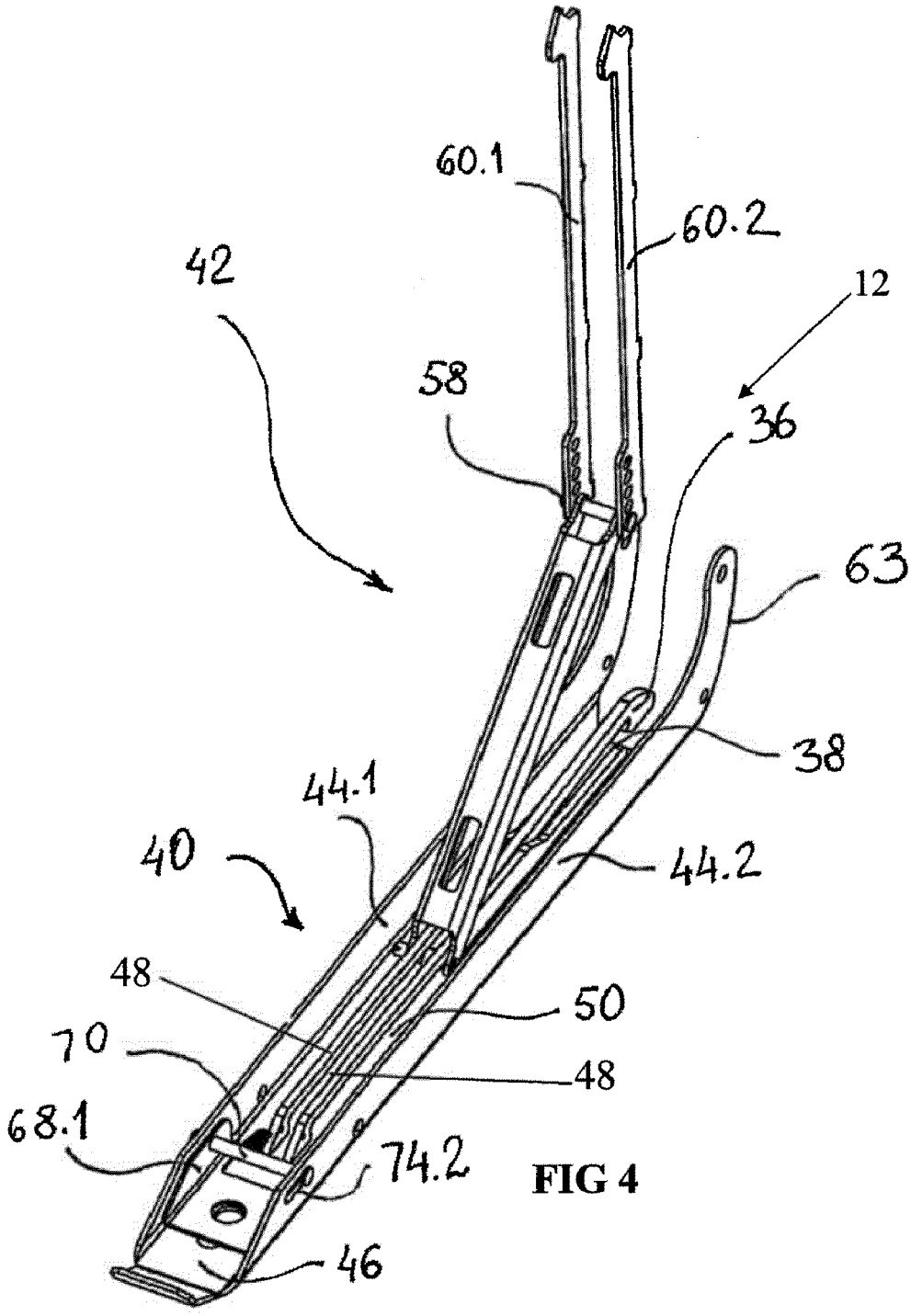
FIG. 4 is a perspective view of the parking stand of FIG. 1.
Figure 5:
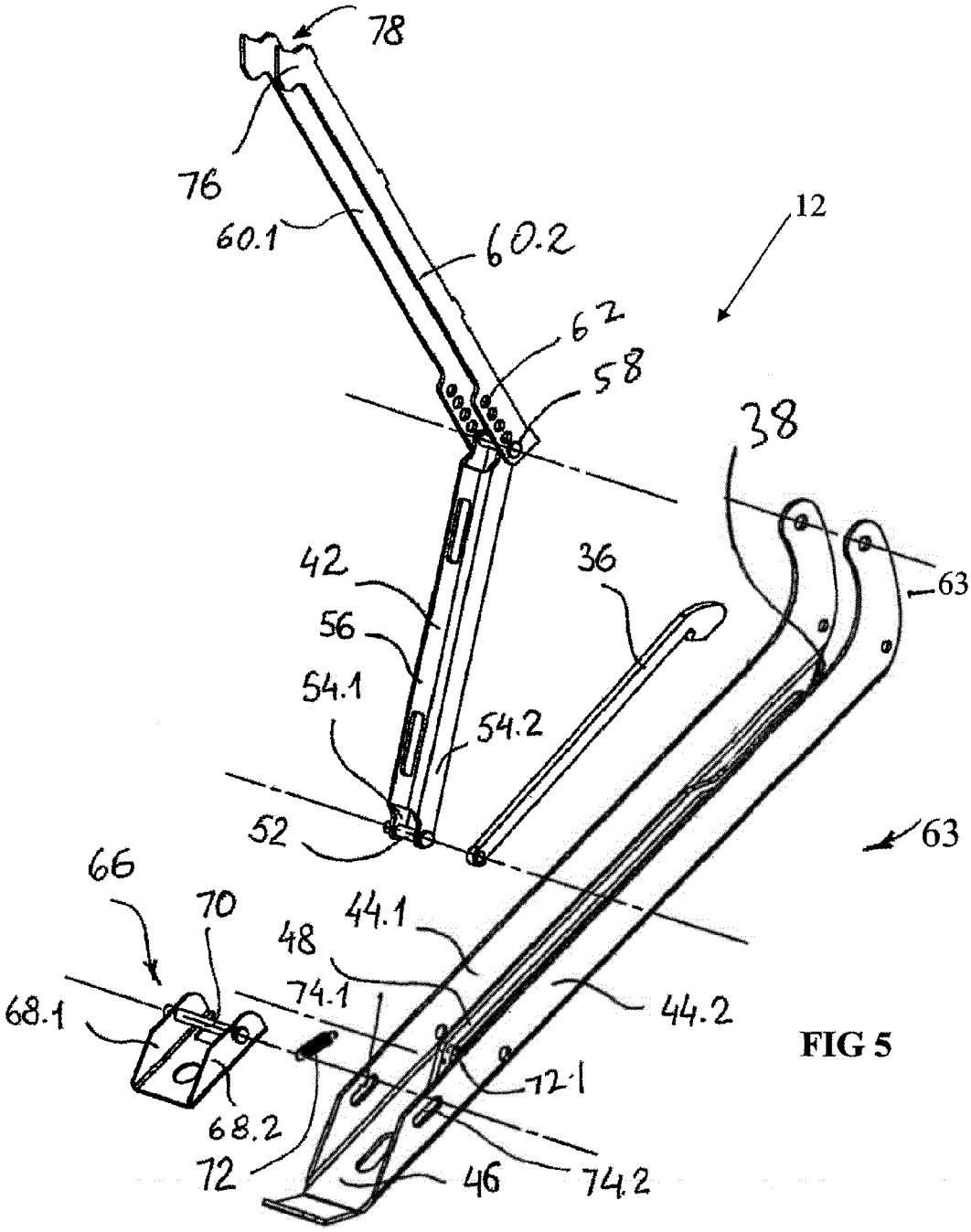
FIG. 5 is an exploded view of the parking stand of FIG. 1.
Figure 6:
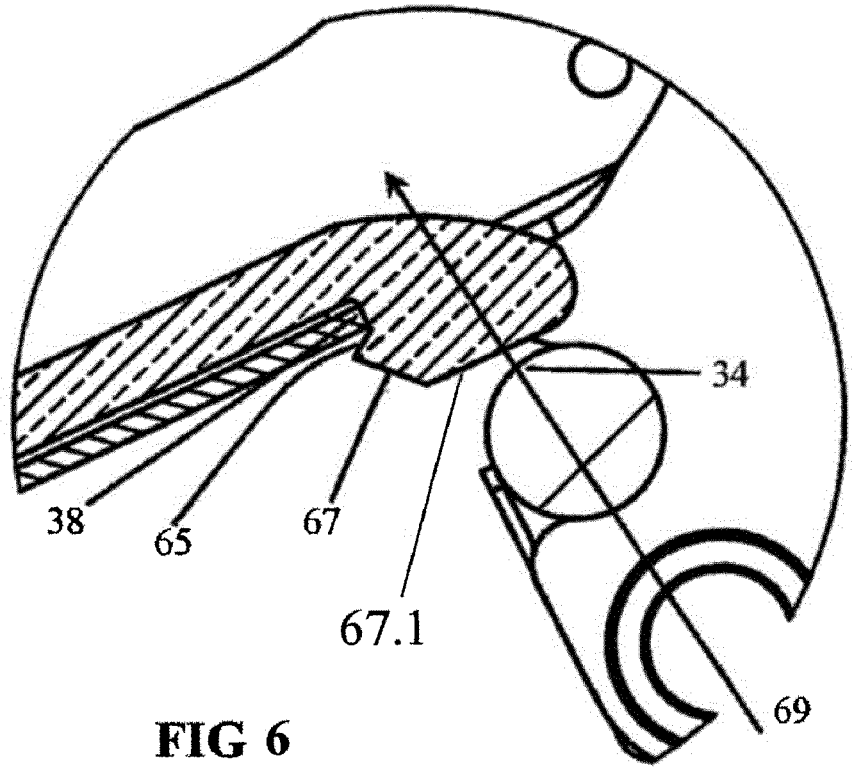
FIG. 6 illustrates an enlarged view of the catch member of the parking stand.

As best illustrated in FIGS. 1, 4 and 5, the bucket 18 includes two pairs of brackets 32.1, 32.2 and 32.3, 32.4 fixed to the rear wall of the bucket 18. Each of the brackets 32.1, 32.1 and 32.3, 32.4 are formed from a plate which is held spaced apart from its pair. Extending between the plates of the brackets 32.1, 32.2 and 32.3, 32.4 is an actuating member 34 in the form of a pin having a generally horizontal axis. The members 34 can be welded or otherwise fixed to the plates of the pair of the brackets.

Figure 2:
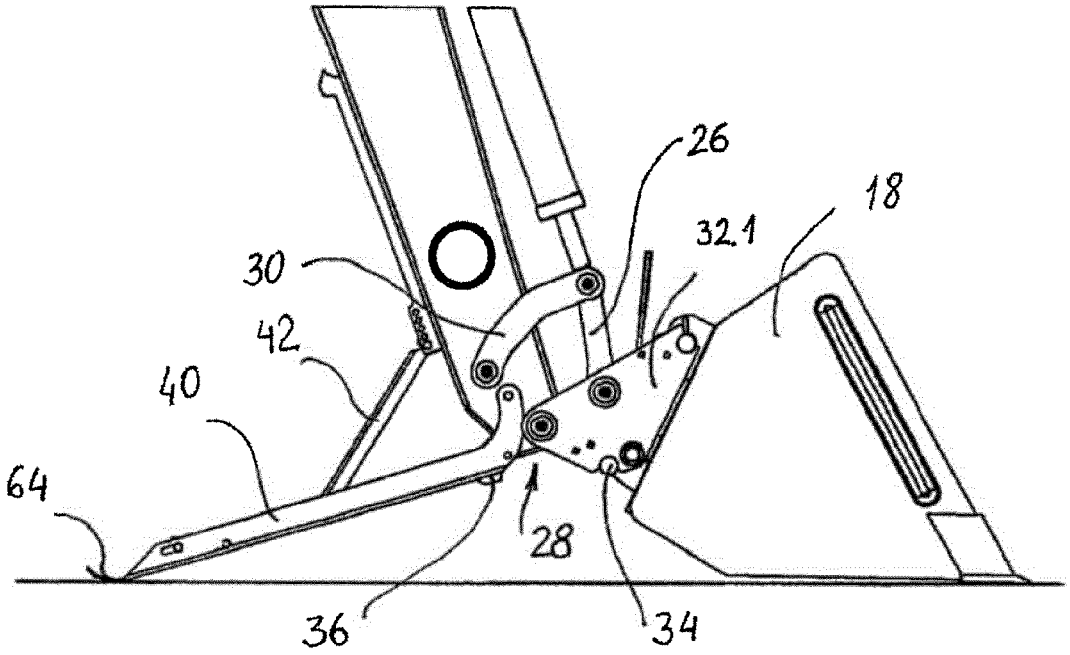
FIG. 2 is an enlarged side view of a forward portion of the front loader of FIG. 1 showing the parking stand in an extended condition.

Referring to FIG. 2, the members 34 are configured to align with and impinge against a catch member 36 of the parking stand 12 in use to thereby automatically disengage the catch member 36 from an edge 38 of a support leg 40 of the parking stand 12.

Figure 10:
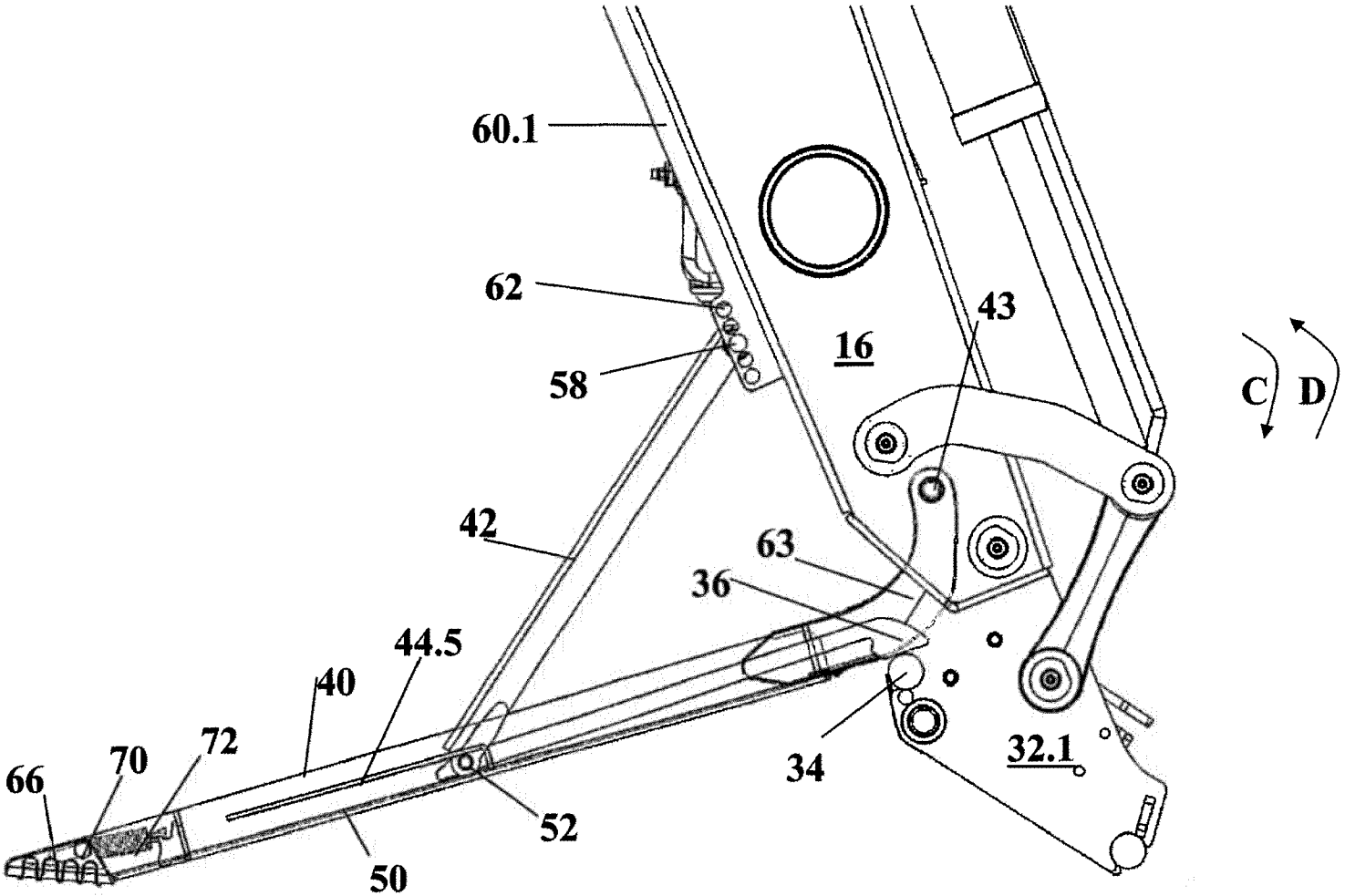
Figure 11:
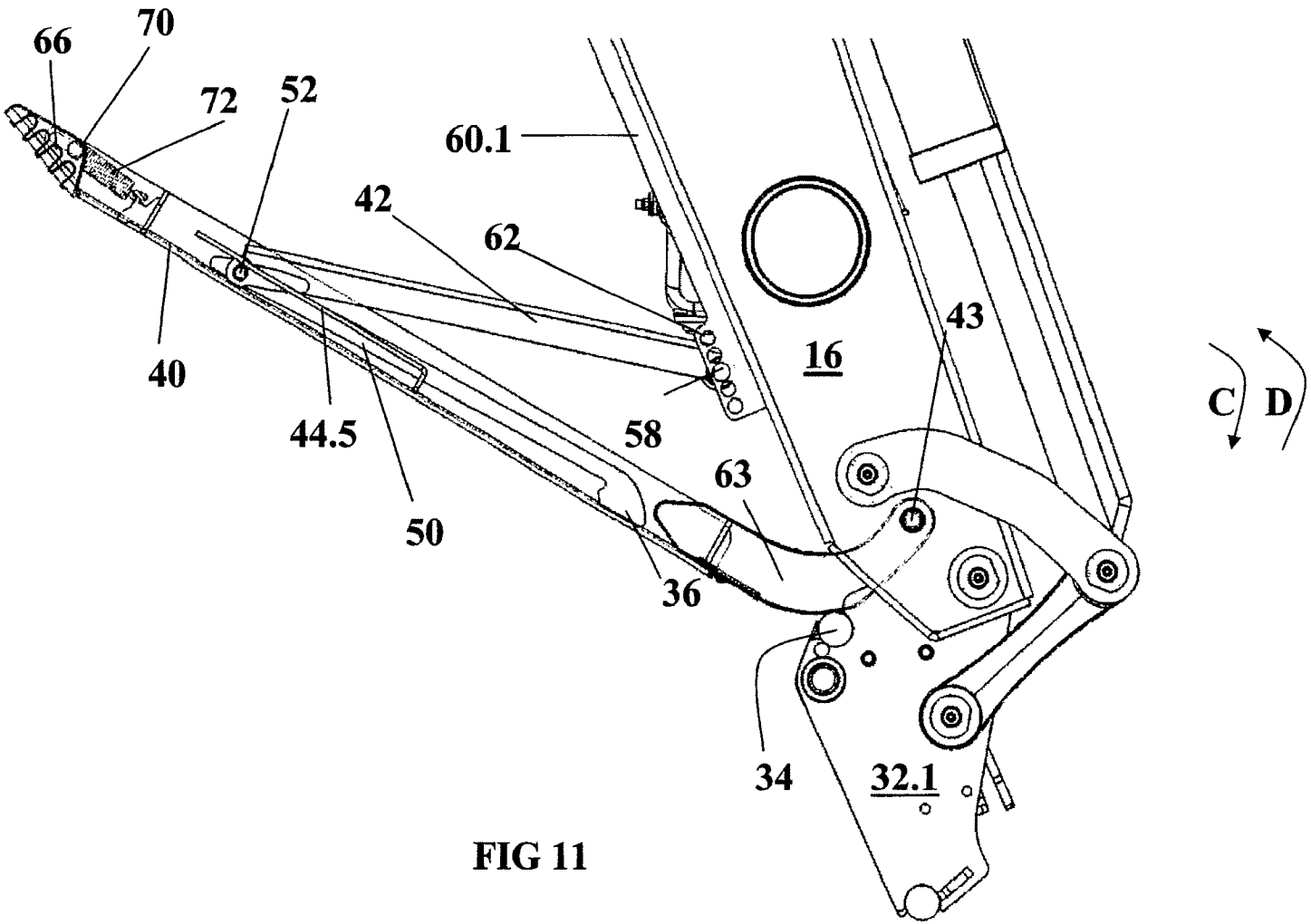

As best illustrated in FIGS. 10 and 4, the parking stand 12 includes the support leg 40 and a strut 42. The support leg 40 is pivotably connected to the boom 16 by pivot means 43 providing pivotal movement of the leg 40 in a suitable angular range.

As can be seen in FIG. 4, each support leg 40 includes a pair of side portions 44.1, 44.2 joined by a central portion 46 to form a generally U-shaped cross section. The central portion 46 includes an elongated guide 48 arranged between the side portions 44.1, 44.2.

As best illustrated in FIGS. 4 and 5, the guide 48 is provided with a guide slot 50 formed therein. The guide slot 50 is adapted to receive a cross pin 52, the arrangement being such that the cross pin 52 can be guided along the guide slot 50 in a direction generally parallel to the support leg 40.

Pivotably attached to the cross pin 52 are the catch member 36 and the strut 42.

The strut 42 is defined by a pair of opposite sides 54.1, 54.2 interconnected by a web 56 so as to form a U-shaped channel sized and shaped to receive the catch member 36.

The strut 42 is connected to the boom 16 for pivoting about a pivot axis defined by a pin 58. The pin 58 is removably attached to a pair of brackets 60.1, 60.2 fixed to the underside of the boom 16. The brackets 60.1, 60.2 are provided with a plurality of apertures 62 for adjusting an angle of the strut 42 with respect to the support leg 40. This can be useful in connecting different types of equipment.

As illustrated in FIG. 4, the support leg 40 includes a transverse portion 63 which is also curved so as to be adapted to abut the actuating member 34. At the opposite end of the support leg 40 is a foot or ground engaging portion 64. Adjacent the ground engaging portion 64 is a spring-loaded locking mechanism 66 including two opposing side portions 68.1, 68.2 and a biased cross pin 70 extending therebetween. The cross pin 70 is connected to the guide 48 via a spring 72 and a hole 72.1. The spring 72 biases the cross pin 70 inwardly with respect to the guide 48.

Figure 12:
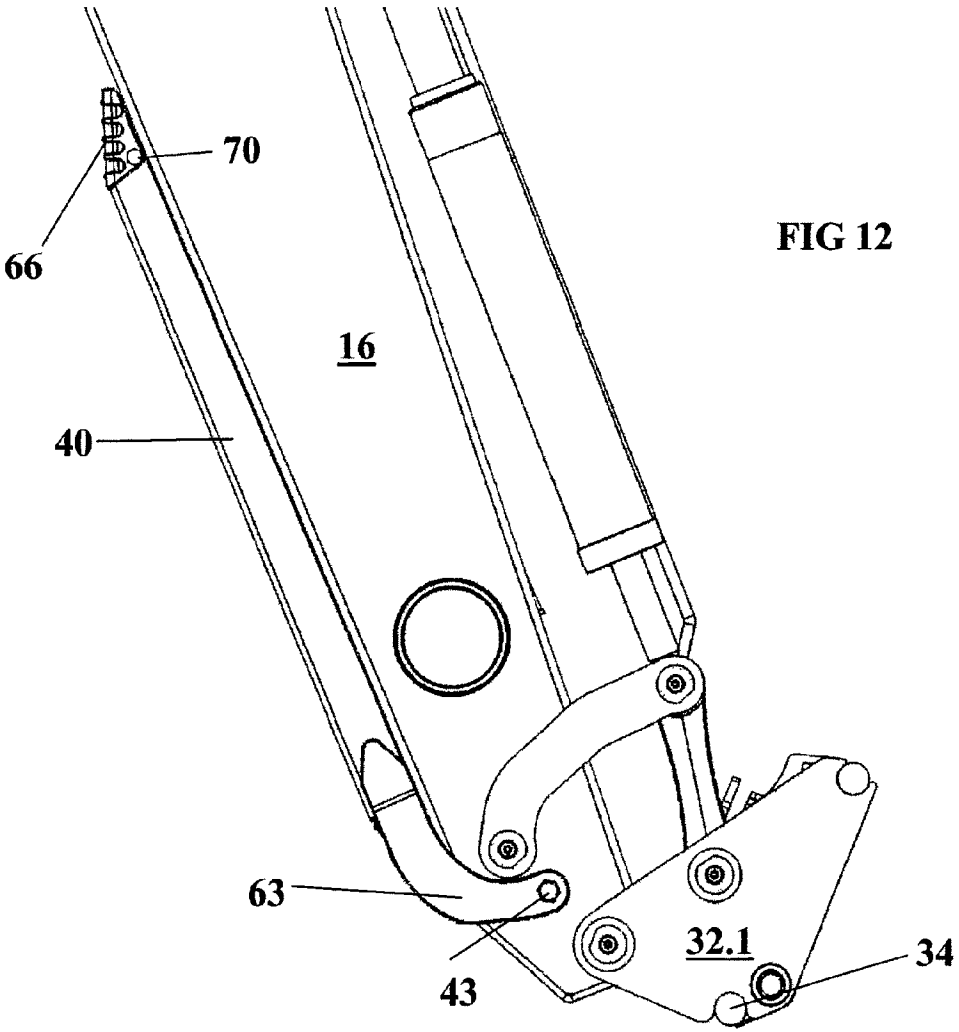

End portions of the pin 70 are adapted to be slidably received in longitudinal slots 74.1, 74.2 provided in the side portions 44.1, 44.2 of the support leg 40. The locking mechanism 66 is configured to align with and impinge against latch members 76 of the brackets 60.1, 60.2 to lock the parking stand 12 in a storage position, as is illustrated in FIG. 12. In this position the strut 42 is positioned within a channel defined by the side members 44.1, 44.2 of the support leg 40 and the channel 48, while the catch member 36 is positioned within and lies against the channel 48 throughout its length.

When the parking stand 12 is in its storage position, a projection 78 of the latch member 76 engages the cross pin 70 to lock the support leg 40 in a locked condition. Thus, the latch 76 is automatically moveable to the locked condition by the bias of the spring 72. The latch 76 is released manually.

Figure 8:
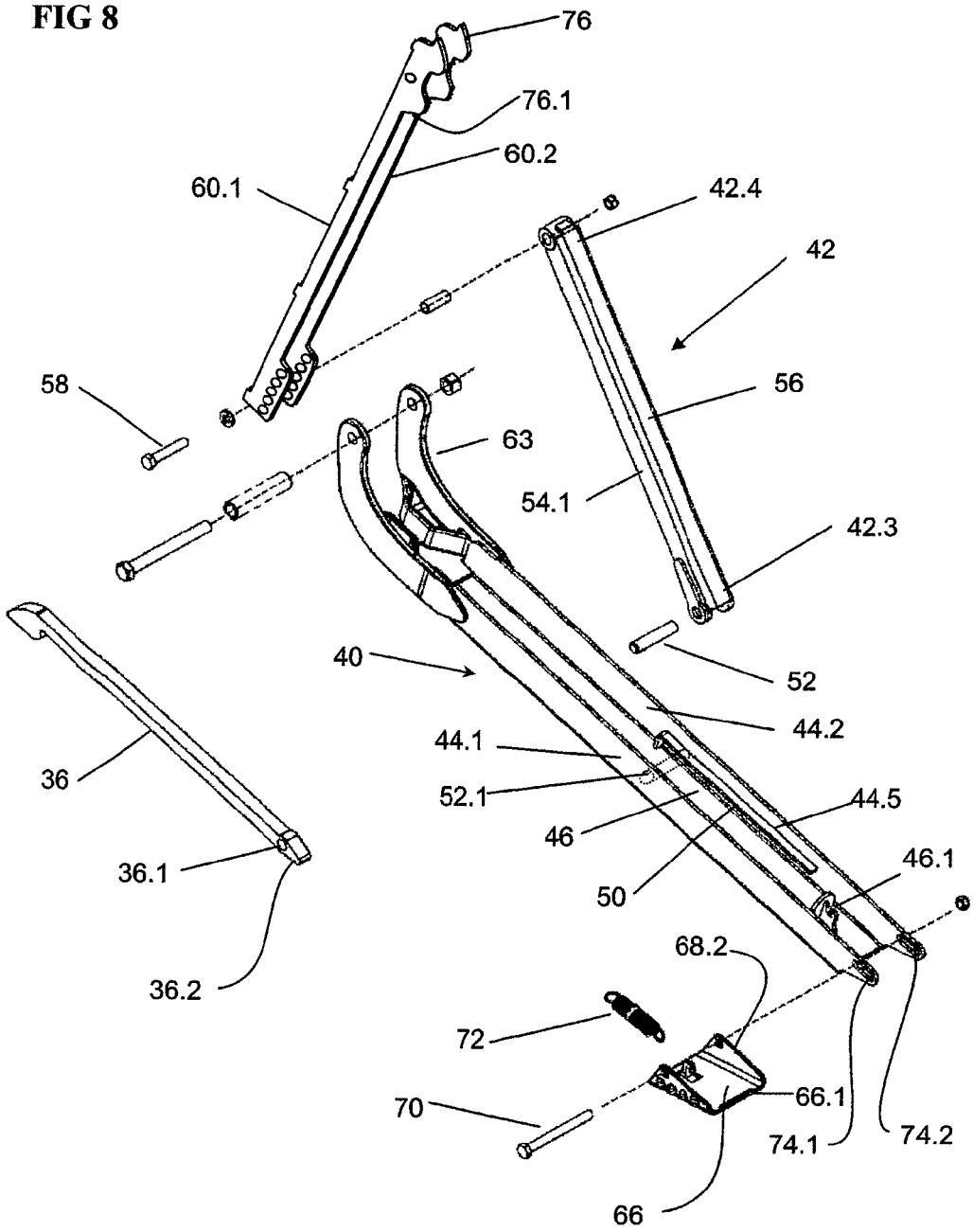
FIG. 8 illustrates modifications for the support stand.

FIG. 8 illustrates modifications to the support leg 40 and strut 42. The strut in this embodiment does not have the bifurcated ends shown in FIG. 5. This increases the strength of the strut. The removal of the bifurcation has been made possible by changing the position of the guide slot 50 from the base of the central portion 46 of the support leg 40 to the side walls 44.1, 44.2 of the support leg 40. The guide slot function is now performed by a pair of strip members, of which 44.5 is shown on the inside of wall 44.2. The complementary strip member is attached to the inside of wall 44.1 and is not shown in FIG. 8. The strip members can be attached to the walls by welding. The pin 52, which passes through the pivot holes at the end 44.3 of strut 40 and through the pivot hole 36.1 of latching tang 36, is extended to be received under the strip members 44.5 and its complementary element as shown in dotted outline at 52.1.

Brackets 63.1 and 63.2 have been added to the curved transverse elements 63 of the strut 40 to provide a guide for the latching end of the latching tang 36. These brackets also provide additional strength for the elements 63.

In addition, the latching tang 36 is extended beyond the pivot hole 36.1 in an extension 36.2. This serves as a rotational limiter to prevent the tang 36 from rotating too far when it is disengaged.

The fixed foot 64 of FIG. 4 has been replaced by a spring loaded foot 66 which also combines the function of the spring loaded latch mechanism. This is achieved by providing a spring attachment means, such as post 66.1, which provides a spring attachment which is eccentric with respect to the pivot pin 70. A further spring attachment 46.1 can be provided on the base portion 46 of the strut 40. Hence the spring 72 provides a torque which tends to bias the rearward edge latching element-support foot element 66 (being that edge furthest away from the spring attachment 46.1) in a downward or clockwise direction relative to FIG. 8.

The side walls 44.1, 44.2 of the strut 40 and the slots 74.1, 74.2 now project beyond the central portion 46 of the strut 40. Pin 70 passes through the pivot holes in the locking member/footing 66 and through holes 74.1, 74.2 to confine the longitudinal travel of member 66.

The rear end 76.1 of the storage latch members 76 have been extended towards the pivot pin 58 to compensate for the changes resulting from the combination of the footing and locking functions in member 66.

The parking stand 12 described above in respect of FIGS. 1 to 7, and FIG. 8 operates as follows. The following description, with reference to FIGS. 9 to 14 will utilise the embodiment of FIG. 8, but it will be readily understood that the embodiment of FIGS. 1 to 7 operates in a similar manner.

Figure 13:
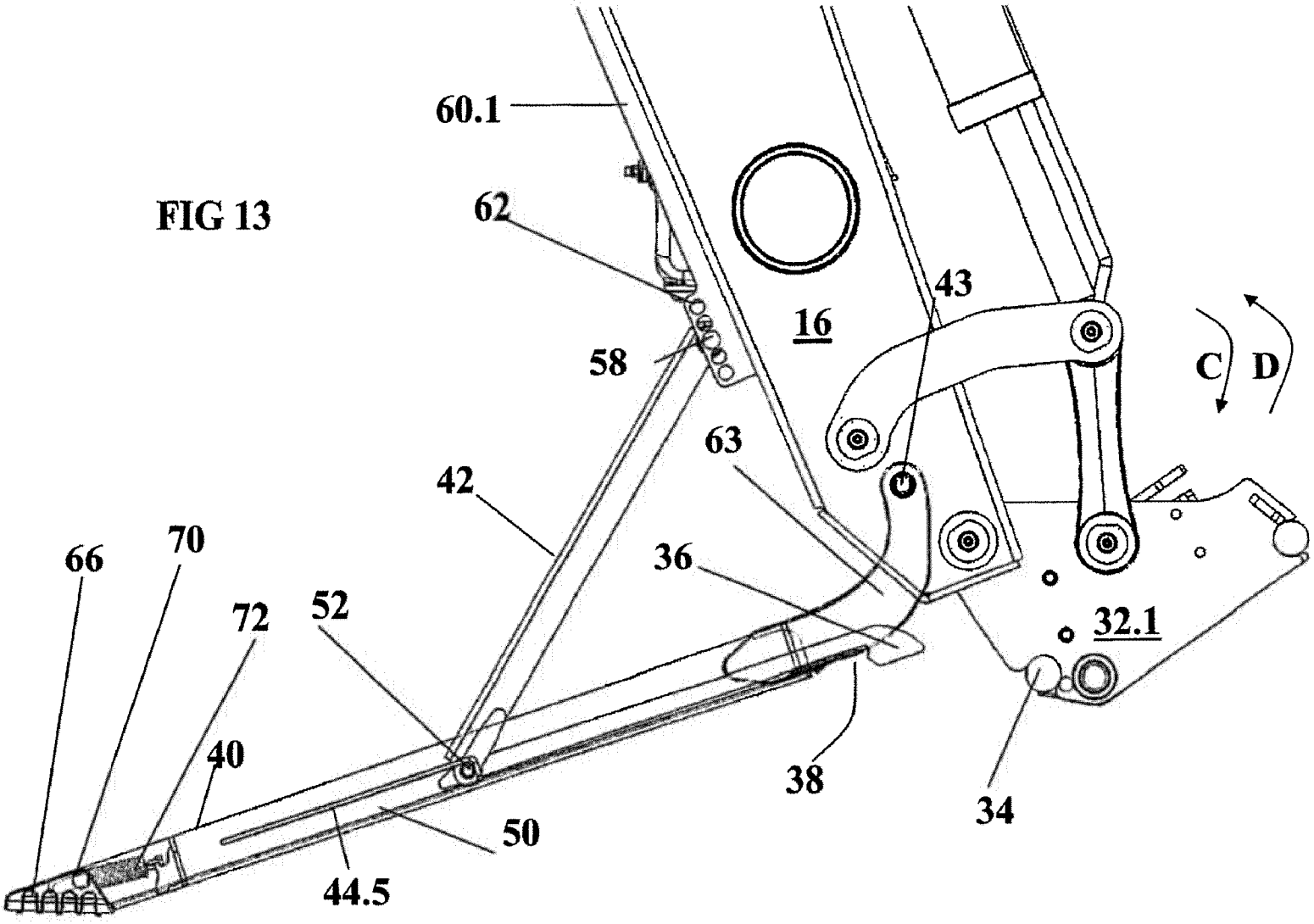
FIGS. 13 and 14 show successive stages in deployment of the parking stand of FIG. 8 wherein the parking stand assumes the fully extended condition.

The parking stand 12 is mounted to the boom 16, with the catch 36 being in a locked position as shown in FIG. 13, when the parking stand 12 is in an extended condition. Whereas in FIG. 12 the parking stand is shown in a retracted condition wherein the catch 36 is released, and the latch 76 is engaged by the pin 70.

Once the front loader 10 has to be re-attached to a vehicle (eg, a tractor), the front loader 10 is then raised away from the ground, as is illustrated in FIG. 3. The hydraulic circuit of the implement cylinder 22 is then activated to rotate the bucket 18 and the brackets 32.1, 32.2, 32.3, 32.4 attached thereto in a clockwise direction as indicated by arrow C in FIGS. 3 and 9.

Figure 7:
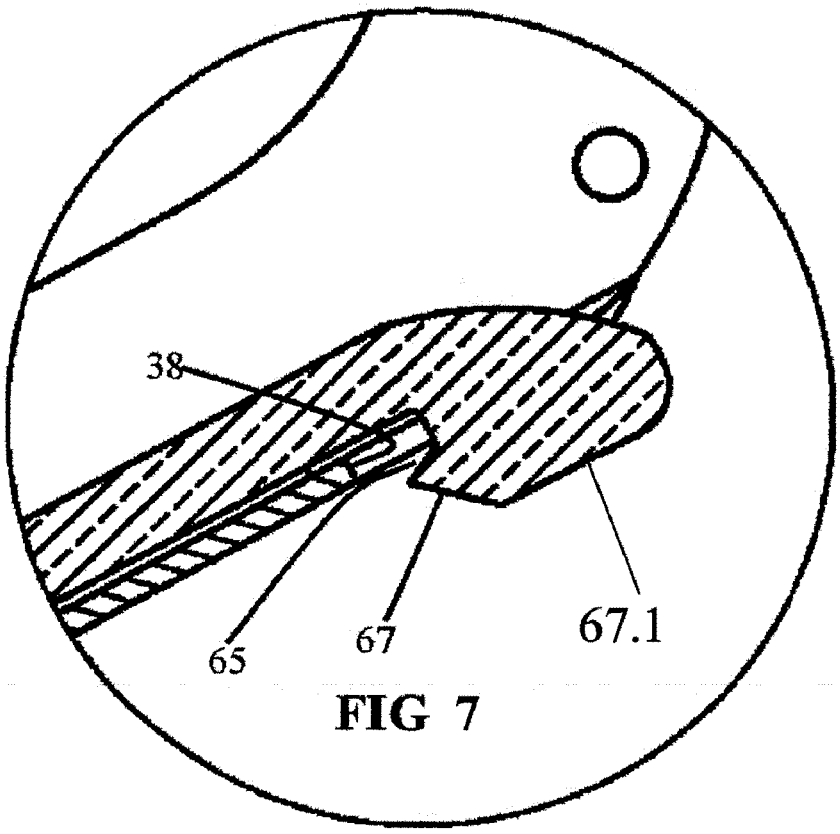
FIG. 7 illustrates another enlarged view of the catch member of the parking stand.

The parking stand 12 can be unlocked by a variety of methods. In one method, the unlocking of the catch member 36 can be effected automatically by the operator raising the boom 16 so that the implement or implement mount is off the ground and the boom is wholly in the air. This will bring the arrangement similar to that illustrated in FIG. 3, and in this situation, the weight of the parking stand will automatically unlock the catch member 36 by relative movement so as to move the catch member 36 to the position illustrated in FIG. 7. In FIG. 7 it can be seen that the material located between the inclined planes 65 and 67 can freely pass the edge 38, to allow the park stand to freely move to the retracted position by the implement or implement mount engaging it as it rotates clockwise in the direction of arrow C of FIG. 3 or 9.

In a second method, as best illustrated in FIG. 10, the pivoting movement of the brackets 32.1, 32.2, 32.3, 32.4 relative to the boom 16 can cause the front surface of the member 34 can contact an inclined plane 67 (best illustrated in FIG. 6 or 7) on the catch member 36 causing the catch member 36 to move upwardly and outwardly relative to the engaging end portion or edge 38 of the leg 40 thereby disengaging the catch member 36.

In a third method of unlocking the catch member 36, this can be done by the member 34 rotating into contact with the catch member 36, and by contacting the flat face 67.1 (see FIGS. 6 and 7) thereof and applying force thereto in the direction of arrow 69, the inner inclined plane 65 will also then cause the catch member 36 to move upwardly and outwardly relative to the engaging end portion or edge 38 of the leg 40 thereby disengaging the catch member 36.

In a fourth method, the parking stand can be manually retracted by an operator lifting the catch member 36 out of engagement with the edge and manually pushing it clear, then manually folding the parking stand to its retracted and locked condition. This may be needed in case an implement or implement mount is of a shape that may not engage the catch member 36 to release it or may not engage the parking stand to retract the parking stand.

One of the first, second, third or fourth methods described above may need to be utilised depending upon the several factors including how high the boom 16 has been raised; the shape of an implement fitted to the implement mount; the degree of balance of the boom on the parking stand without an implement being present; the size and shape of the implement mount.

Once the catch member 36 is released, as the implement mount or brackets 32.1, 32.2, 32.3, 32.4 continue rotating further, the actuating member 34 first abuts the outside surface of the support leg 40, near to the curved portion 63 of the leg 40 causing the support leg 40 to pivot upwardly. The actuating member 34 then abuts and slides over and with respect to the curved portion 63 of the support leg 40. During this movement of the leg 40, the cross pin 52 slides toward the pivoting foot 66 of the support leg 40, pushing the strut 42 to its locked condition till the cross pin 70 is brought into a locking engagement (against the bias of spring 72) with the latch 76, as is shown in FIG. 12. As a result, the support leg 40 is swiveled upward into its stored position, in order to prevent interfering with the operation of the front loader 10. The bucket 18 (not illustrated in FIGS. 9 to 14) and the brackets 32.1, 32.2, 32.3, 32.4 are then rotated back to a working position illustrated in FIG. 12.

During use, the biasing force exerted by the spring 72 prevents the pin 70 from moving to the unlocked or partially locked condition.

Figure 14:
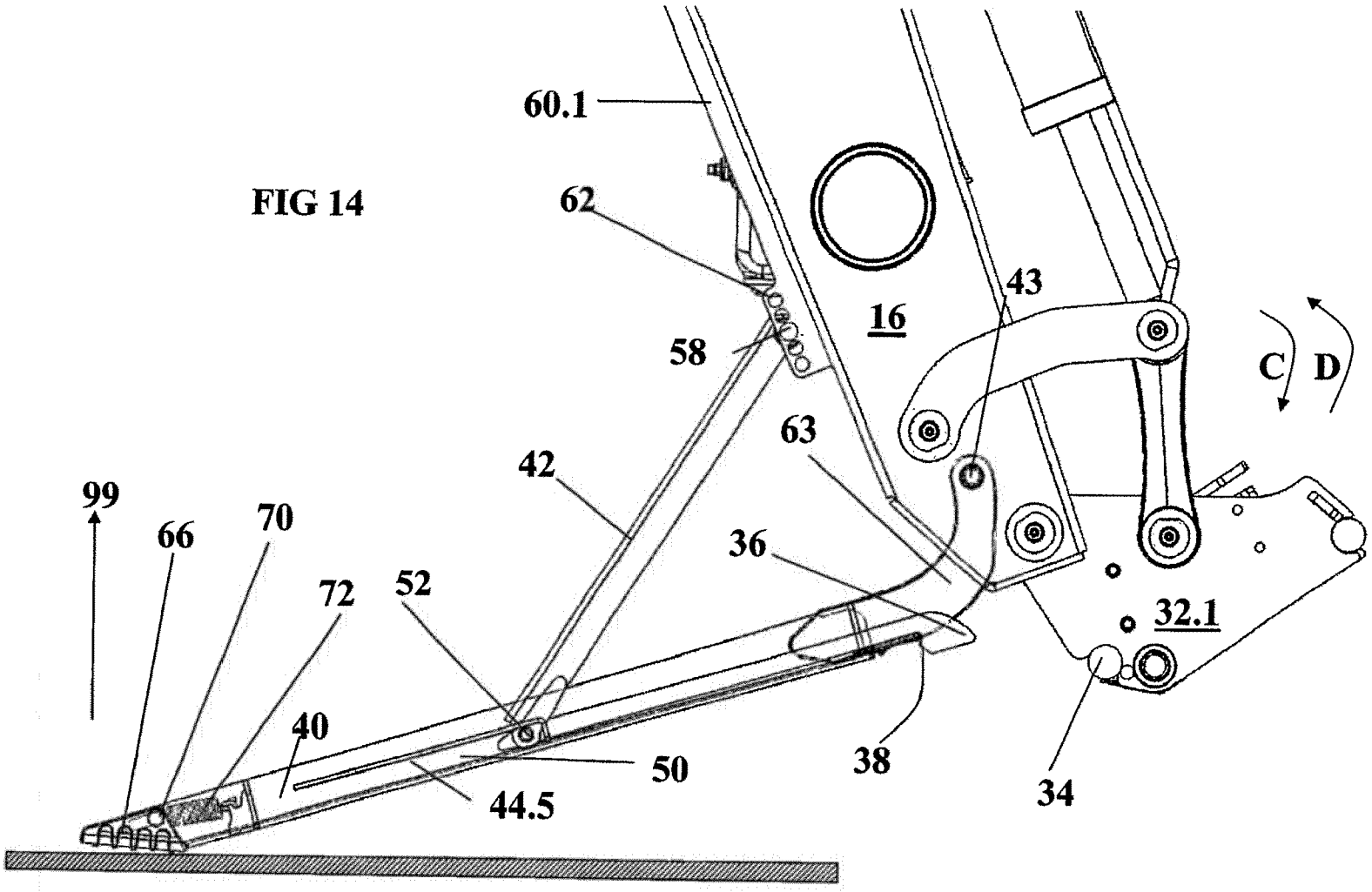

Once the front loader 10 has to be disconnected from the vehicle, the parking stand 12 is manually rotated to the extended condition by releasing the pin 70 from the latch 76. When the pin 70 is released, the strut 42 and the support leg 40 tend to pivot in the downward direction due to the force of gravity or by human assistance. As illustrated in FIG. 14, the cross pin 52 restricts this pivoting movement of the parking stand 12 by preventing the strut 42 from sliding out of the guide 50. As the parking stand 12 is pushed up by the ground in the direction of arrow 99 of FIG. 14, the hook-shaped end of the catch member 36 engages the edge 38 of the support leg 40 thereby locking the parking stand 12 in its park position, as is illustrated in FIG. 14.

While the above embodiment incorporates the use of implement mounting means for moving the parking stand from an extended position to a retracted position, it will be understood by those skilled in the art that there are many ways in which the present invention can be embodied. In particular, an implement (eg, a tilting bucket) can be provided with a portion adapted to move the parking stand to its retracted position. Alternatively, a loader can include a movable member mounted thereon so as to unlock and move the parking stand. It will be further appreciated by those skilled in the art that the present invention can use remote actuation means for moving the parking stand to its retracted position.

Many of the parts of the above parking stand can be manufactured by any appropriate method or material, such as folded and or rolled components, steel castings, welded components and the like. The type of material and manufacturing method will be dependent upon the weight of the front loader that needs to be supported by the parking stand when deployed.

As an example the support leg or stand 40 which is described above can be a formed part, and have the guides 48 or 44.5 welded to the base or sides respectively thereof. As an alternative this could be substituted by the support leg or stand 40 being made of cast steel and the guides 48 or 44.5 being cast into the base or side walls respectively of the support leg or stand 40.

Moving the guide rails 48 to the sides of the support leg or stand 40, as in the embodiment of FIGS. 8 to 14, will allow the gap to be reduced between the strut 42 or its web 56 and the catch member 36, which in turn will thereby make the load bearing surfaces of these components adjacent to each other so as to reduce the forces which would result in bending the pin 52, as the pin 52 will be more in shear than bending.

Other modifications can be made, such as the latch members 76, brackets 60.1 and 60.2, and apertures 62 can be integrally formed in the underside of the boom 16. Alternatively, discrete latch members 76 and bracket portions having holes 62 can be formed integrally with or attached to the underside of the boom 16 thereby dispensing with the long brackets 60.1 and 60.2.

The invention described above thus provides a device wherein a parking stand of a front end loader can be automatically folded from an extended condition to a retracted condition.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A loader including:

at least one loader arm having a moveable implement mount at one end thereof, a parking stand including a support leg pivotally attached to said arm for pivoting about an axis, and a pivoted strut attached to the arm and moveably engaged with the support leg, said support leg being movable between a retracted position and an extended position, and lock means for locking said stand in said extended position, the lock means including a catch adapted to engage the support leg in the extended position to lock the support leg in the extended position and configured to be disengaged from the support leg by the movable implement mount engaging the catch, wherein said movable implement mount is able to be moved to an engagement position in which it engages the catch to release said catch to thereby unlock said support leg.

2. A loader as claimed in claim 1, wherein the lock means is connected to the pivoted strut.

3. A loader as claimed in claim 1 wherein said movable implement mount is adapted to engage said parking stand and move the parking stand from said extended position to said retracted position.

4. A loader as claimed in claim 1 including tilting means for tilting said implement mount relative to said arm, whereby said tilting means operably engages said lock means to thereby unlock said lock means.

5. A loader as claimed in claim 1, including lift means for moving said arm between a raised position and a lowered position.

6. A loader as claimed in claim 1, further including retaining means provided on said loader arm for releasably securing said parking stand in the retracted position.

7. A loader as claimed in claim 4, wherein said moveable implement mount includes an implement mounting means that includes actuating means for automatically releasing said lock means, said actuating means being operably connected to said tilting means.

8. A loader as claimed in claim 7 wherein said actuating means includes an actuating member, said actuating member being operably connected to the tilting means, the arrangement being such that during tilting movement of the implement the actuating member aligns with and impinges against the catch to thereby automatically release said lock means.

9. A loader as claimed in claim 8 wherein upon said release of said lock means, further tilting movement of said moveable implement mount will cause the parking stand to pivot to its retracted position.

10. A loader as claimed in claim 9 wherein further tilting movement of said moveable implement mount will cause an automatic locking of said retaining means to thereby secure said parking stand in the retracted position.

11. A loader as claimed in claim 6, wherein said retaining means includes spring means for normally biasing said retaining means toward a latching position.

12. A parking stand assembly for a loader, the assembly including a parking stand having a support leg pivotally attached to a loader arm, said parking stand being movable between a retracted position and an extended position; and retaining means for releasably securing said parking stand in the extended position, wherein said retaining means is released by a portion of said loader being made to engage said retaining means.

13. A parking stand assembly as claimed in claim 12 wherein, upon release of said retaining means, said portion moves said parking stand from said extended position to said retracted position.

14. A parking stand assembly as claimed in claim 12 wherein said loader includes tilting means for tilting an implement relative to the loader arm and wherein said movable portion is operably connected to said tilting means.

15. A parking stand as claimed in claim 12, including a retraction latch adapted to releasably retain the stand in the retracted position.

16. A parking stand as claimed in claim 15, including a spring loaded ground engaging foot combined with the retraction latch.

17. A parking stand for a loader, said parking stand including a support leg, said parking stand being movable between an extended position and a retracted position, wherein the support leg includes a contact surface adapted to contact a movable implement mount of said loader, the arrangement of said movable implement mount of said loader and said contact surface being such that said movable portion is adapted to move said parking stand from said extended position to said retracted position.

18. A parking stand as claimed in claim 17 wherein said contact surface includes a planar surface.

19. A parking stand as claimed in claim 17 wherein said contact surface includes a curved surface.

20. A method of folding a parking stand for a loader having a movable implement mount, said parking stand including retaining means for releasably securing said parking stand in an extended position, said method including the step of engaging said retaining means with the implement mount, to automatically release said retaining means by manipulation of said implement mount.

21. A method as claimed in claim 20 wherein upon said release of said retaining means, further operation of said implement mount will cause the parking stand to move to its retracted position.

* * * * *